US008707577B2

(12) United States Patent
Lee et al.

(10) Patent No.: US 8,707,577 B2
(45) Date of Patent: Apr. 29, 2014

(54) ADJUSTABLE HAIR DRYER

(76) Inventors: Gary Brian Lee, Rancho Cordova, CA (US); Alan Heine, Fair Oaks, CA (US)

( * ) Notice: Subject to any disclaimer, the term of this patent is extended or adjusted under 35 U.S.C. 154(b) by 310 days.

(21) Appl. No.: 13/297,428

(22) Filed: Nov. 16, 2011

(65) Prior Publication Data

US 2012/0124854 A1 May 24, 2012

Related U.S. Application Data

(60) Provisional application No. 61/415,483, filed on Nov. 19, 2010, provisional application No. 61/510,313, filed on Jul. 21, 2011.

(51) Int. Cl.
*A45D 20/12* (2006.01)

(52) U.S. Cl.
USPC ..... 34/97; 34/100; 132/212; 392/385

(58) Field of Classification Search
USPC ..... 34/96, 97, 98, 99, 10; 132/118, 212; 392/384, 385
See application file for complete search history.

(56) References Cited

U.S. PATENT DOCUMENTS

| | | | | | |
|---|---|---|---|---|---|
| 1,254,042 | A | | 1/1918 | Howe | |
| 1,781,879 | A | * | 11/1930 | Norden | 392/379 |
| 1,968,381 | A | * | 7/1934 | Drannon | 34/87 |
| 1,994,163 | A | | 3/1935 | Augustus | |
| 2,385,121 | A | * | 9/1945 | Williams | 392/383 |
| 2,496,597 | A | * | 2/1950 | Newman | 34/90 |
| 3,099,386 | A | | 7/1963 | Pieper | |
| 3,132,232 | A | * | 5/1964 | Freedman et al. | 392/384 |
| 3,491,774 | A | | 1/1970 | Carbone | |
| 3,555,699 | A | * | 1/1971 | Nelson | 34/97 |
| 3,797,752 | A | | 3/1974 | Cercone | |
| 3,846,047 | A | | 11/1974 | Okutu et al. | |
| 3,986,272 | A | | 10/1976 | Feierabent | |
| D250,722 | S | | 1/1979 | Cousins et al. | |
| 4,197,448 | A | * | 4/1980 | Harigai | 392/384 |
| 4,316,077 | A | | 2/1982 | Carlson | |
| 4,409,998 | A | | 10/1983 | Bauer | |
| 4,466,203 | A | | 8/1984 | Thomas | |
| 4,556,782 | A | * | 12/1985 | Fujishima et al. | 392/384 |
| 4,603,246 | A | | 7/1986 | Gosta | |
| 4,636,613 | A | | 1/1987 | Bressler et al. | |
| 4,673,148 | A | | 6/1987 | Oliver | |
| 4,701,595 | A | * | 10/1987 | Okutsu et al. | 392/385 |
| 4,712,313 | A | | 12/1987 | Gettleman | |
| 4,904,847 | A | * | 2/1990 | Kosaka et al. | 392/384 |
| 4,977,306 | A | * | 12/1990 | Kosaka et al. | 392/380 |
| 5,268,988 | A | | 12/1993 | Kakuya | |

(Continued)

FOREIGN PATENT DOCUMENTS

| | | | | | |
|---|---|---|---|---|---|
| EP | 79101 | A2 | * | 5/1983 | A45D 20/10 |
| GB | 2075953 | A | * | 11/1981 | A45D 20/08 |
| JP | 04348702 | A | * | 12/1992 | A45D 20/12 |

*Primary Examiner* — Steve M Gravini
(74) *Attorney, Agent, or Firm* — Law Office of David M. Lang; David M. Lang

(57) ABSTRACT

Embodiments of the present invention include an adjustable hairdryer permitting a user to rotate and vertically adjust the barrel portion of a hand-holdable dryer. Embodiments of the invention disclose ball-and-socket and disc joint couplings between a hairdryer barrel and handle. Embodiment linkage apparatus is disclosed providing mechanical contact between the barrel and a rotatory electrical interface, permitting the barrel to be freely rotatable relative to the handle while maintaining electrical contact.

18 Claims, 14 Drawing Sheets

(56) References Cited

U.S. PATENT DOCUMENTS

| | | | | |
|---|---|---|---|---|
| 5,279,048 | A | 1/1994 | Hellman | |
| 5,636,815 | A | 6/1997 | Wilson | |
| 5,640,781 | A * | 6/1997 | Carson | 34/97 |
| 5,727,331 | A | 3/1998 | Ng et al. | |
| 5,832,624 | A * | 11/1998 | Narrin | 34/97 |
| 5,851,106 | A | 12/1998 | Arnieri et al. | |
| 5,884,008 | A * | 3/1999 | Goldberg | 392/385 |
| 5,937,537 | A | 8/1999 | Miller | |
| 5,940,980 | A * | 8/1999 | Lee et al. | 34/97 |
| 5,970,622 | A | 10/1999 | Bahman | |
| 5,987,772 | A | 11/1999 | Cheng | |
| 6,155,782 | A | 12/2000 | Hsu | |
| 6,189,229 | B1 | 2/2001 | Thomas et al. | |
| 6,199,805 | B1 | 3/2001 | Pena | |
| 6,393,208 | B1 * | 5/2002 | Nosenchuck | 392/384 |
| 6,449,870 | B1 | 9/2002 | Perez et al. | |
| 6,520,467 | B2 | 2/2003 | Thomas et al. | |
| 6,671,460 | B1 | 12/2003 | Smal | |
| 6,691,429 | B1 | 2/2004 | Carlucci | |
| 6,782,636 | B2 | 8/2004 | Feldman | |
| 6,966,125 | B2 | 11/2005 | Rago et al. | |
| 8,353,303 | B2 * | 1/2013 | Kim | 132/118 |
| 2002/0026727 | A1 | 3/2002 | Cheung | |
| 2004/0075033 | A1 | 4/2004 | Fujitaka | |
| 2005/0108890 | A1 | 5/2005 | Park | |
| 2007/0290110 | A1 * | 12/2007 | West et al. | 248/314 |
| 2008/0240690 | A1 * | 10/2008 | Ono et al. | 392/384 |
| 2010/0045427 | A1 * | 2/2010 | Boone et al. | 340/5.23 |
| 2010/0089413 | A1 | 4/2010 | Wright et al. | |
| 2010/0307019 | A1 * | 12/2010 | Park et al. | 34/90 |
| 2012/0124854 | A1 * | 5/2012 | Lee et al. | 34/97 |
| 2013/0008043 | A1 * | 1/2013 | Correll et al. | 34/97 |
| 2013/0247269 | A1 * | 9/2013 | Alburg | 2/68 |

* cited by examiner

ADJUSTABLE HAIR DRYER

CROSS-REFERENCE TO RELATED APPLICATIONS

This application claims the benefit under 35 U.S.C. §119 (e), to U.S. Provisional Application US 61/415,483 filed Nov. 19, 2010, entitled "BLOW DRYER, WITH INTERNAL MECHANICAL LOCKING SWIVEL FOR ERGONOMICALLY DIRECTING BARREL" which is incorporated by reference in its entirety and made part of this specification, and to U.S. Provisional Application US 61/510,313 filed Jul. 21, 2011, entitled "ADJUSTABLE HAIR DRYER" which is incorporated by reference in its entirety and made part of this specification.

FIELD OF THE INVENTION

The present invention relates to apparatus facilitating directionalization of air flow generally, and more specifically to apparatus and methods permitting rotatable adjustment of the barrel of a hand-holdable hair dryer.

BACKGROUND

There are several prior art devices that permit some movement of a hair dryer drying/blowing barrel. For example U.S. Pat. No. 5,940,980 to Lee et al., discloses, in part, an elongated, semi-rigid, semi-flexible, bendable gooseneck tubing connected at one end to the body element of a hair dryer. U.S. Pat. No. 5,884,008 to Goldberg discloses, in part, a portable hair dryer having a foldable hollow pistol-type handle that is pivotally connected to the dryer's tubular housing. U.S. Pat. No. 4,603,246 to Costa discloses, in part, a hair dryer having a body resting on a saddle-shaped base attached to a handle—the base having a pin which projects into a cutout on the handle to limit rotation.

Prior art solutions permit motion in one plane and result in relatively non-smooth movement of the barrel. What is therefore needed is a product which permits a more fluid and greater range of motion.

SUMMARY

One aspect of certain embodiments of the present invention discloses a hair dryer having a barrel that can be manually oriented to change the barrel's direction relative to the handle, thus allowing airflow to be directed is a desired way. Another aspect of certain embodiments of the present invention provides for a push-button actuated release to permit rotational barrel movement. Another aspect of the present invention provides a hairdryer barrel mounted on a handle through a variety of joint connections including ball-and-socket and disc joint connections to permit rotational movement of the dryer's barrel in all directions.

DETAILED DESCRIPTION

Figure 1:
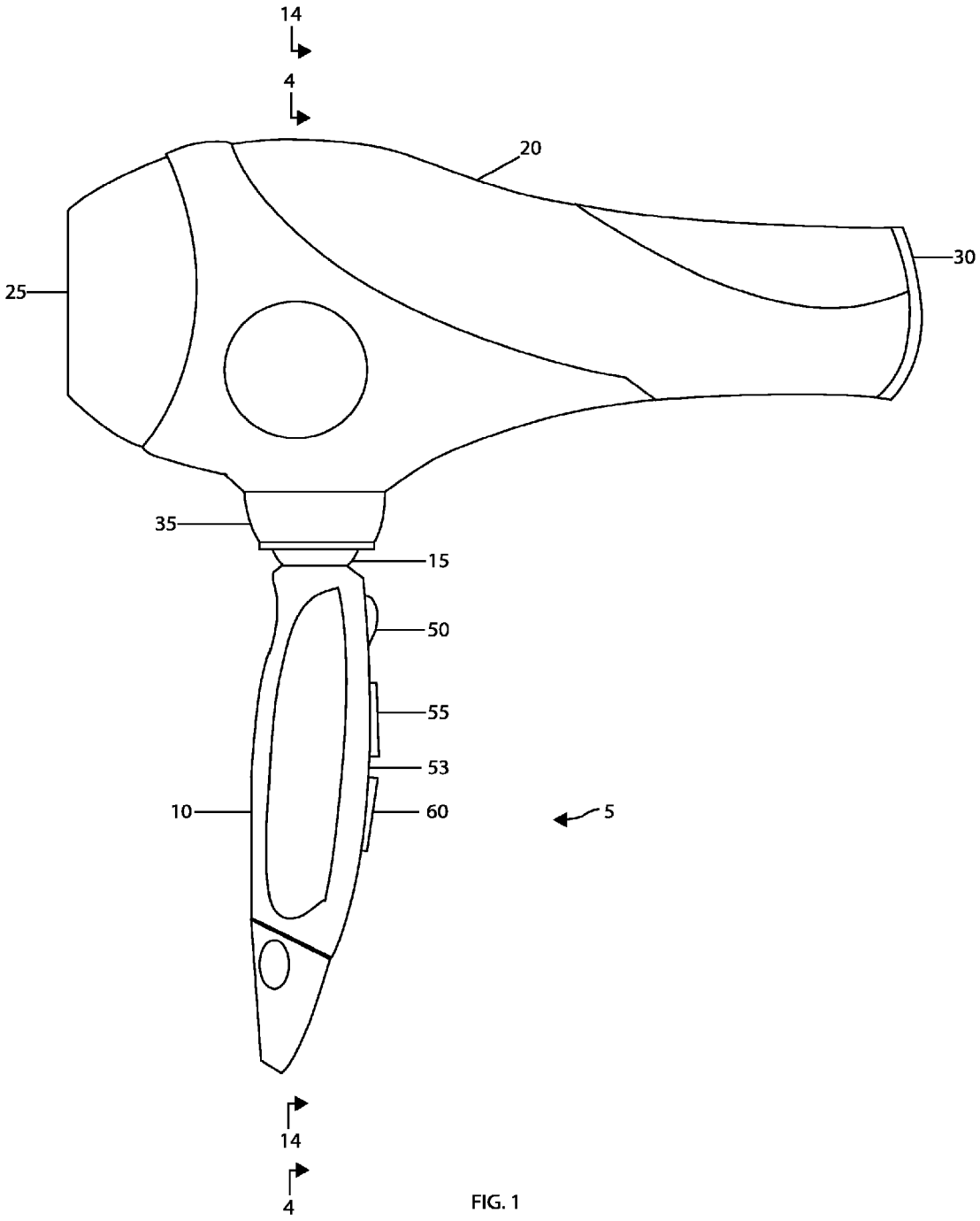
FIG. 1 is a side view of an embodiment hair dryer apparatus.

Turning now to FIG. 1 illustrating an embodiment apparatus 5 that includes handle 10 having a first end and second end, the first end being shaped to form ball 15. In an alternative embodiment, ball 15 may formed independently of handle 10 and affixed thereto. Barrel 20 has intake end 25 and outflow end 30 through which fan-driven air flows.

Figure 2:
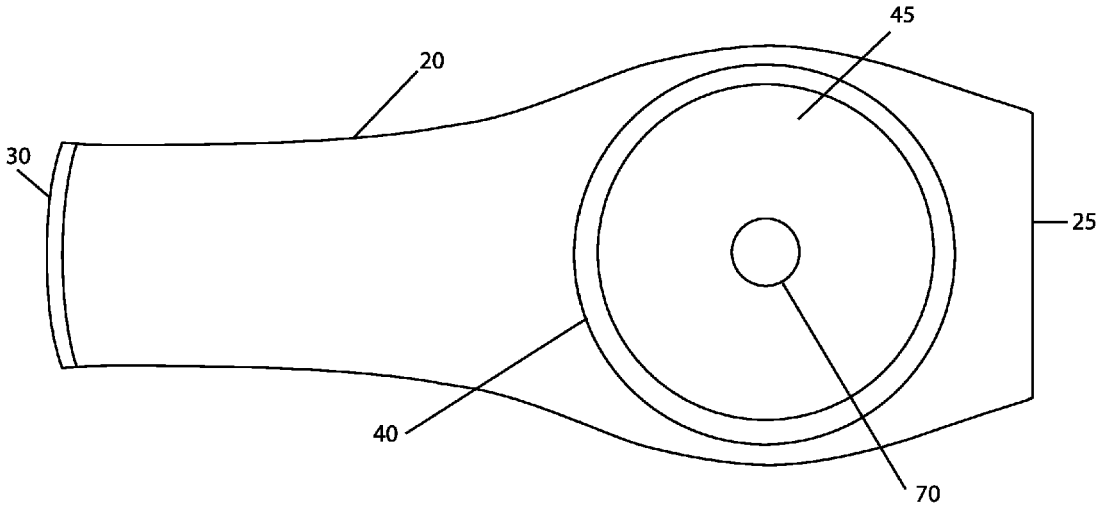
FIG. 2 is bottom view of the barrel of an embodiment dryer.
Figure 3:
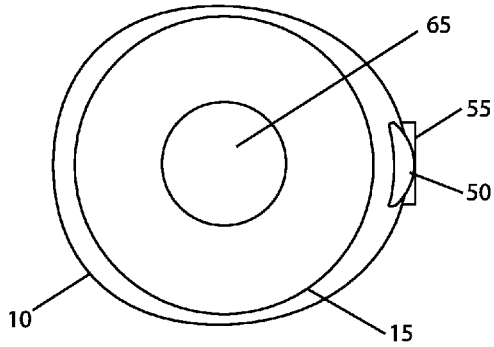
FIG. 3 is a top view of the handle of an embodiment dryer.

Turning to FIG. 2, a portion of the underside of barrel 20 is shaped to define socket 40 to accommodate ball 15. Socket channel 70 is located within socket 40 and serves as an ingress point for wiring. In one embodiment, an optional washer 45 may be disposed within socket 40 to contact ball 15 and increase frictional resistance, but may be omitted where sufficient frictional engagement exists between ball and socket. FIG. 3 demonstrates a top view of ball 15 with ball channel 65 passing therethrough which permits wiring and/or linkage apparatus to pass from within handle 10, through socket channel 70, and into barrel 20. It should be noted that for illustrative purposes, ball 15 and socket 40 are shown as separate components, however, in one embodiment, an independent ball-and-socket joint, having a ball component and socket component, may be utilized with one or both components being incorporated into or secured to handle 10 and barrel 20 provided a channel therein exists to provide wiring to pass from handle 10 to barrel 20. In yet another alternative, a single, integrally formed housing is formed which is shaped to define a ball and socket joint.

Figure 4:
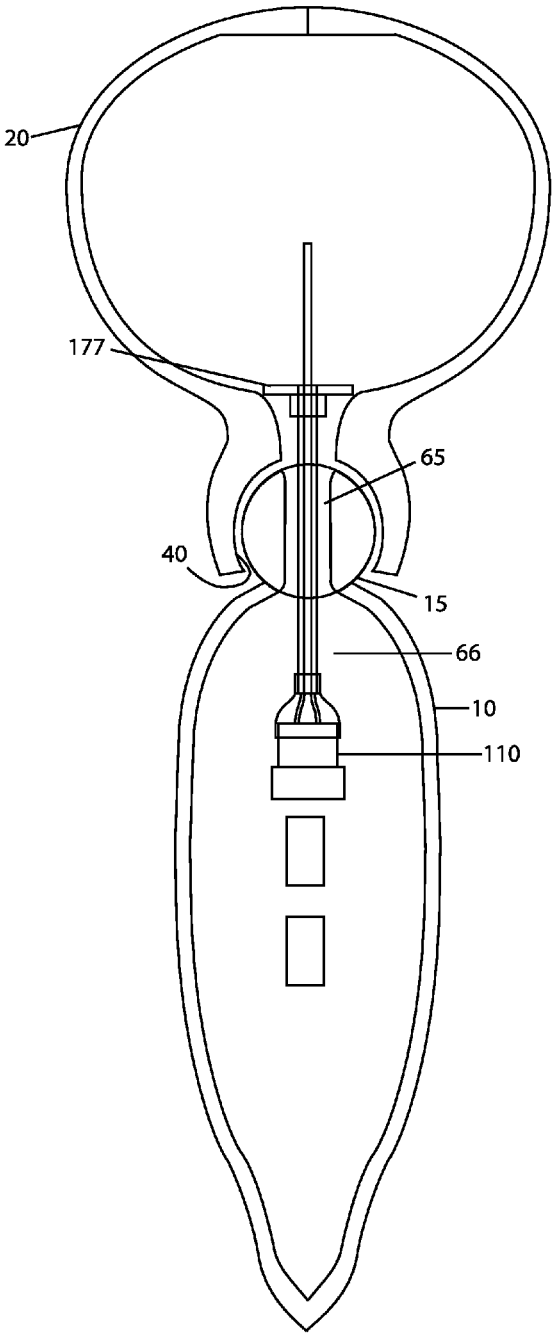
FIG. 4 is a cross-sectional view of an embodiment taken through line 4-4 of FIG. 1.
Figure 5:
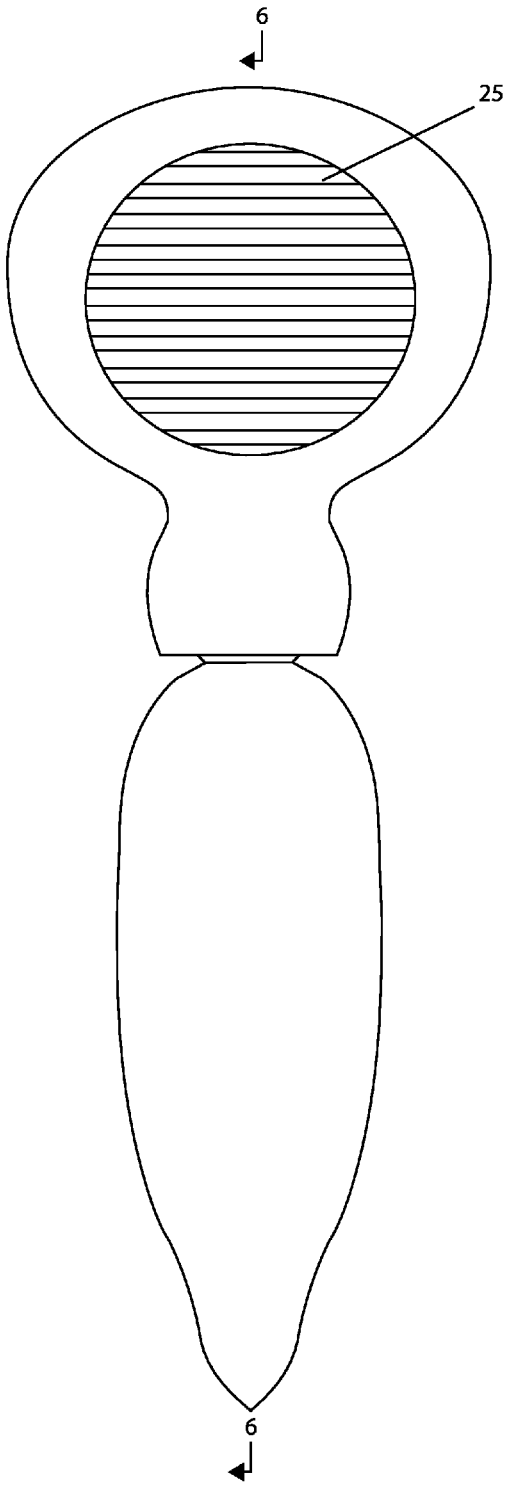
FIG. 5 is a rear elevation view of an embodiment of the present invention.

Turning now to FIG. 4, a rear cross-sectional view is taken through line 4-4 of FIG. 1 is illustrated. Ball 15 is shaped to define channel 65 which permits wiring to pass from within handle 10 into barrel 20. Linkage 66 permits movement between barrel 20 and handle 10 to permit horizontal and vertical movement therebetween; electrical contact is maintained through rotatory electrical interface 110. FIG. 5 is a rear elevation view of an embodiment apparatus.

Figure 6:
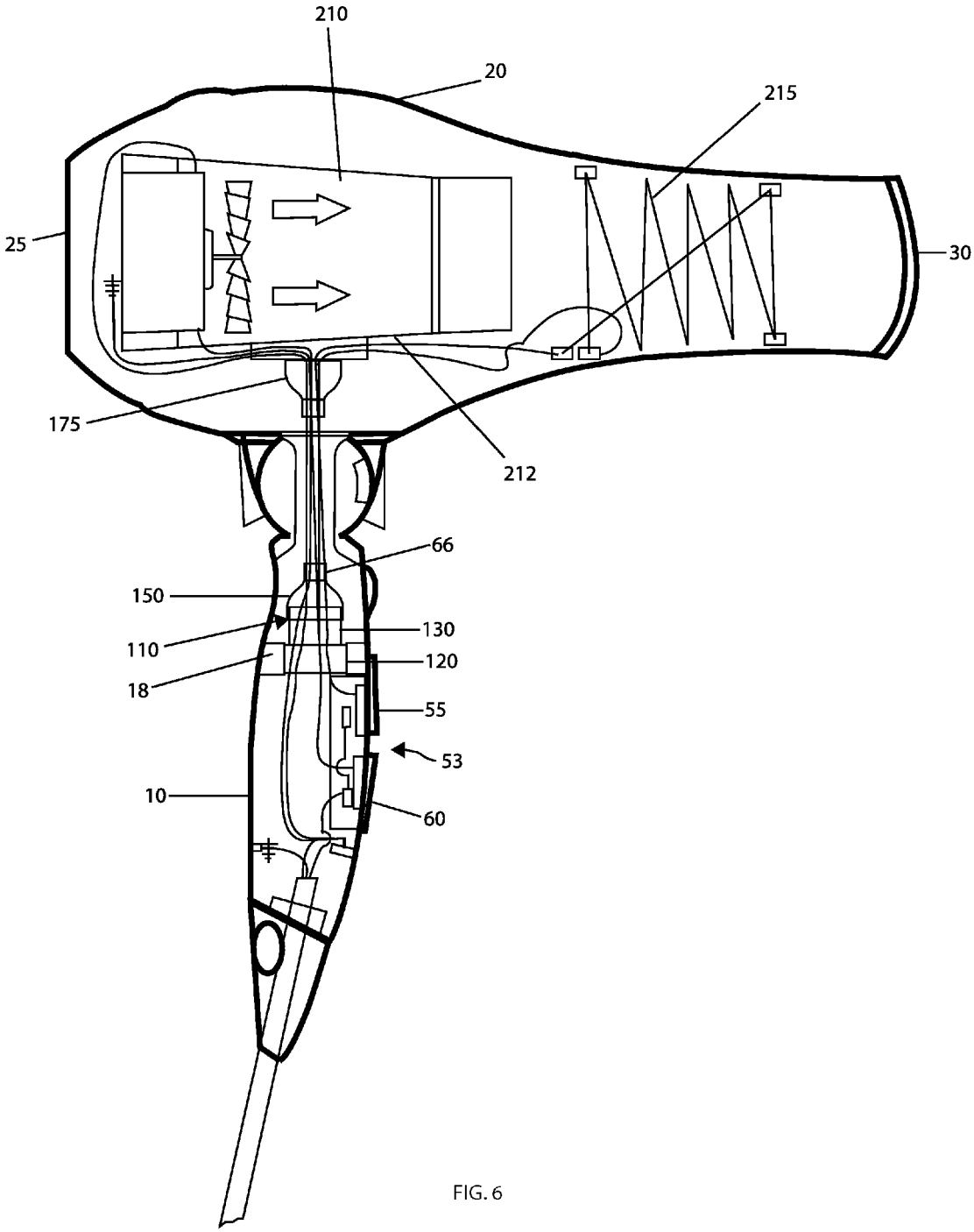
FIG. 6 is a cross-sectional view taken through line 6-6 of FIG. 5.
Figure 7:
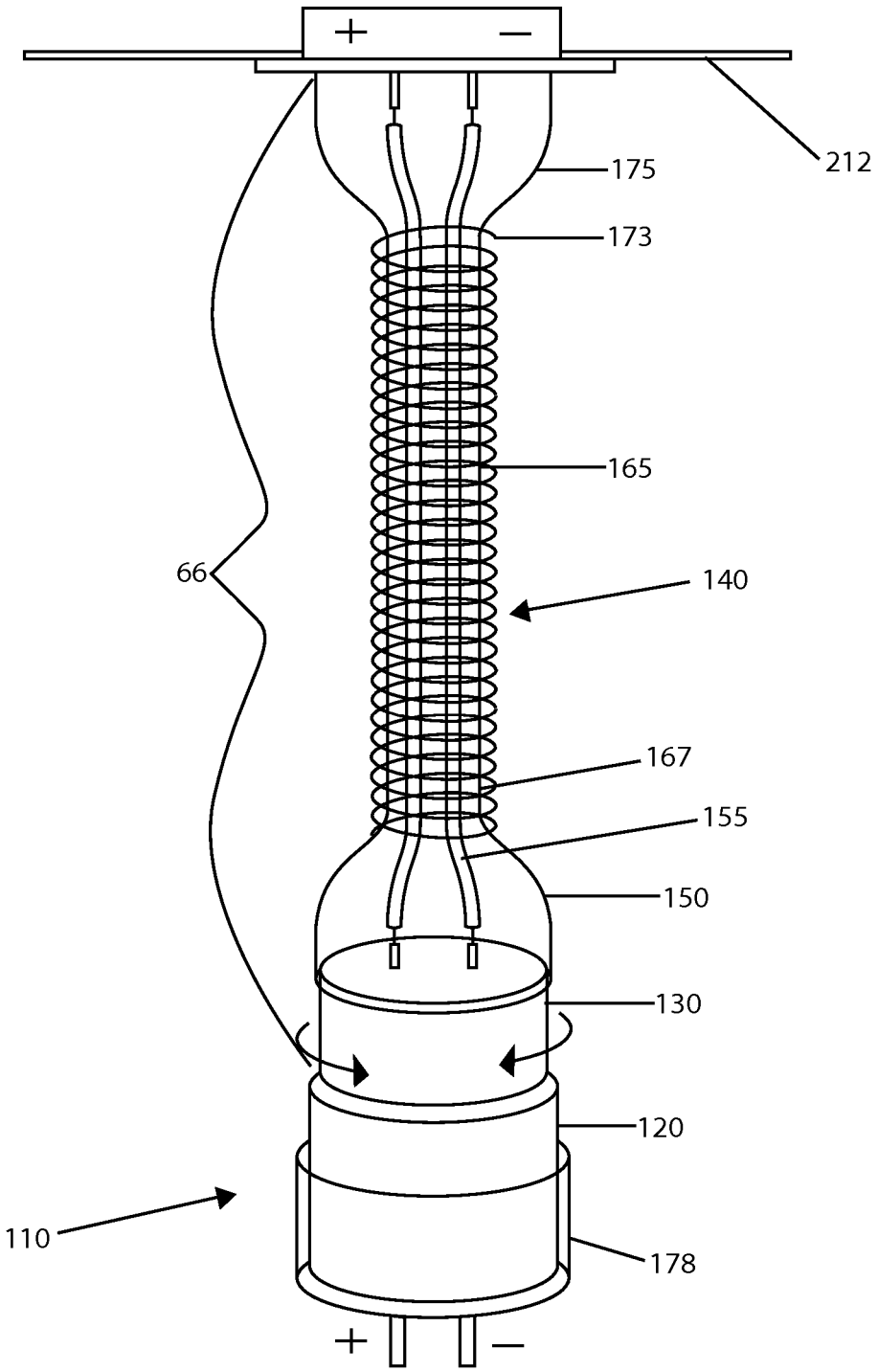
FIG. 7 is a schematic view of an embodiment rotatatory electrical interface and an embodiment linakage.

FIG. 6, is cross-sectional view taken through line 6-6 of FIG. 5. FIGS. 6 and 7 demonstrate an embodiment of linkage 66 engaging an embodiment rotatory electrical interface such as rotating connector 110. Rotating connector 110 has a first end 120 and second end 130, the first end 120 being set and immobilized within a location within handle 10, such as molded recess 178; first end 120 remains stationary and second end 130 is freely rotatable within handle 10. Barrel 20 and handle 10 are operatively coupled by linkage 66, an example of which illustrated by FIG. 7, permitting rotation between barrel 20 and handle 10 while maintaining electrical connectivity between one or more switches 53. It should be clear that, the location of the rotating electrical connector is arbitrary and that in an alternative embodiment, rotating connector 110 is not located within handle 10, but may be located within barrel 20, with a portion of the connector being immobilized and a portion rotatable.

In one embodiment, FIG. 7 demonstrates an embodiment linkage 66 between barrel 20 and handle 10 which includes bundle 140 which runs through channel 65 within ball 15 and channel 70 within socket 40. In one example, bundle 140 comprises: wiring 155 inner sheath (not shown) covering wiring 155, coil 165 wound about inner sheath, and outer sheath (not shown) covering coil 165. Illustration of the inner sheath and outer sheath is omitted so that other structures may be adequately visualized. An embodiment linkage element may be coil 165, which has first end 167 affixed to first cap connector 150 and a second end 173 affixed to second cap connector 175. First cap connector 150 is affixed to first end 130 of rotating connector 110. Second cap connector 175 is affixed to any secure location within barrel 20, such as fan housing 212. In an alternative embodiment depicted by FIG. 4, a second cap connector 177 may be affixed directly on the inside aspect of barrel 20. The entirety of sheath, coil 165, inner sheath, and wires 155, constitute bundle 140. Therefore, as barrel 20 rotates, bundle 140 rotates which rotates cap connector 150 which is affixed to and thereby rotates second end 130 of connector 110 permitting barrel 20 to spin continuously and freely with respect to handle 10 while maintaining electrical contact between switches 53 and fan 210 and heating element 215 through rotating connector 110.

Figure 8:
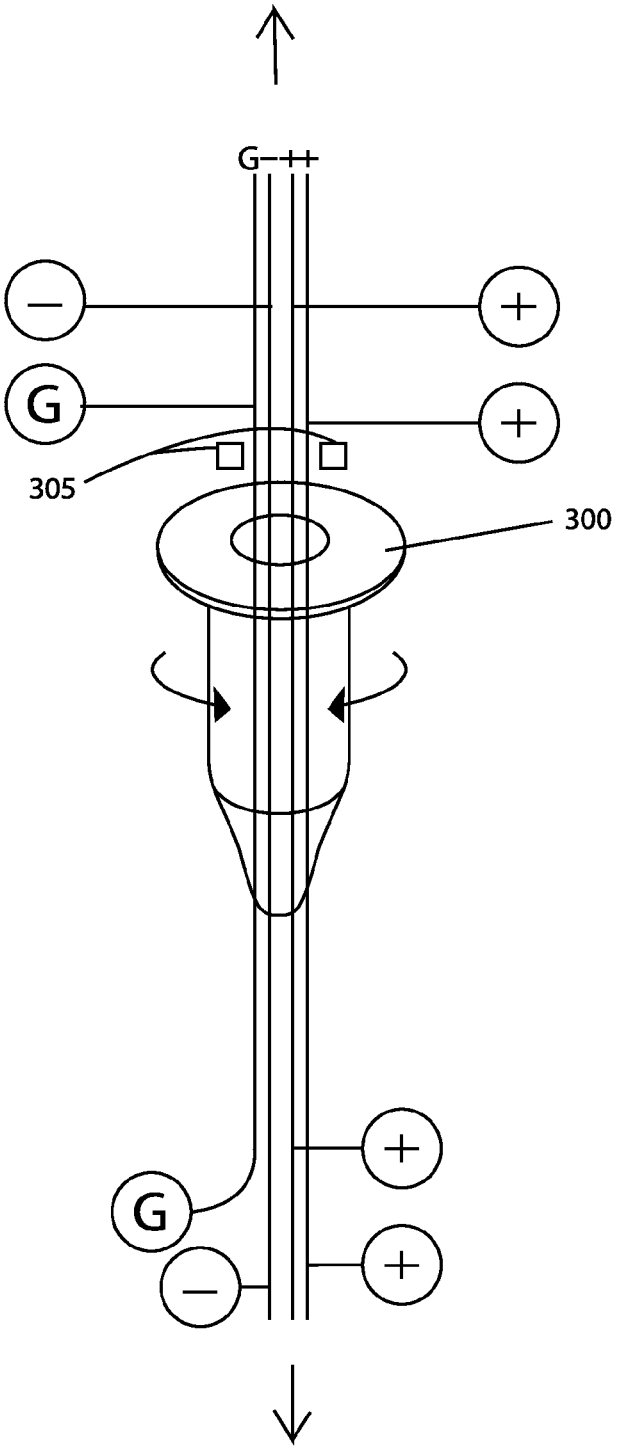
FIG. 8 is a schematic view of an embodiment rotatory electrical interface.

The various workable rotatory electrical interfaces may be comprised of any electrical coupling capable of imparting current from a stationary wire to a rotating contact and ultimately to fan 210 and heating element 215. Examples include a slip ring utilizing brush contact and other types of brushless rotary electrical contact including mercury-wetted slip rings. In one non-limiting example, a rotating connecter such as MERCOTAC Model 230 and 430 may serve as rotating connector 110. An alternative embodiment rotatory electrical interface may be comprised of slip ring system. FIG. 8 illustrates a partially exploded view of an embodiment slip ring system comprising slip ring 300 and brush contacts 305 (contacts 305 illustrated in an exploded view out of electrical contact with ring 300 for illustrative purposes) which could be mounted in any location within handle and/or barrel with either the slip ring 300 or brush contacts 305 being fixed and the other rotatable. In an alternative embodiment a modified slip ring may comprise at least a portion of ball 15 and at least a portion socket 40 being metallic such that electrical current may flow therebetween.

Returning to FIG. 7 as an example of rotating functionality, when barrel 20 rotates, coil 165 rotates causing second end 130 of rotating connector 110 to likewise rotate.

Figure 10:
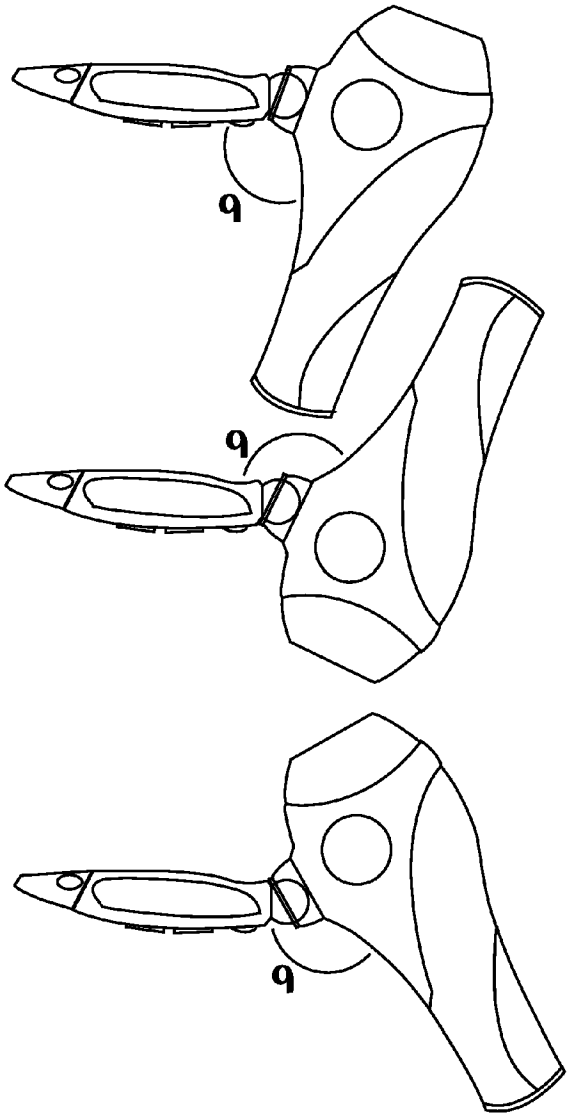
FIG. 10 is an elevation view of an embodiment of the present invention showing example upward and downward rotation through range σ in a vertical plane.

Coil 165 is formed of sufficient gauge to permit rotation of rotating connector 110 as barrel 20 is rotated, yet sufficiently flexible to permit upward and downward vertical movement of barrel 20, as illustrated by FIG. 10. It should be clear from the foregoing that rotation of handle 10 and barrel 20 relative to each other is arbitrary. In an alternative embodiment, first cap connector 150 of switch 110 is fixed within handle 10's housing—wherein second end 120 is freely rotatable. It should also be clear from the foregoing that relative position of rotating connector 110 as described and illustrated is arbitrary; it is specifically recognized that rotating connector 110 may be placed anywhere within handle 10 or barrel 20 to achieve a similar result.

Figure 9:
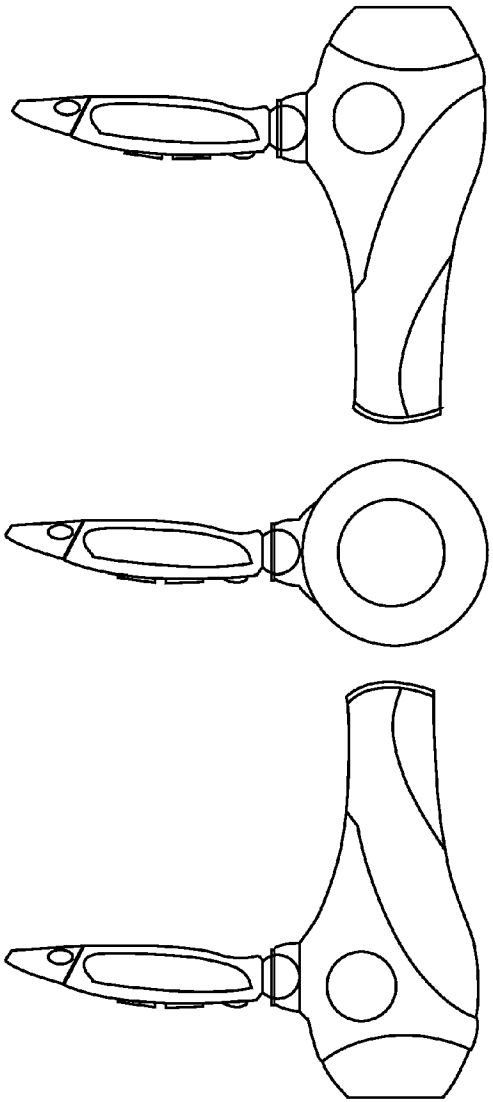
FIG. 9 is an elevation view of an embodiment of the present invention showing example rotational movement in a horizontal plane.

FIGS. 9 and 10 depict an example apparatus horizontal and vertical range of motion. Barrel 20 is freely rotatable on the axis of handle 10 (it follows also that handle 10 is freely rotatable relative to barrel 20). FIG. 10 demonstrates rotation of handle 10 and barrel 20 such that barrel 20's terminus 30 and handle 10 may be brought closer together or moved further apart. In one embodiment a range of motion, represented by $\sigma$ on FIG. 10, may be 60 degrees. In other embodiments, the workable range may be 170 degrees.

Figure 11:
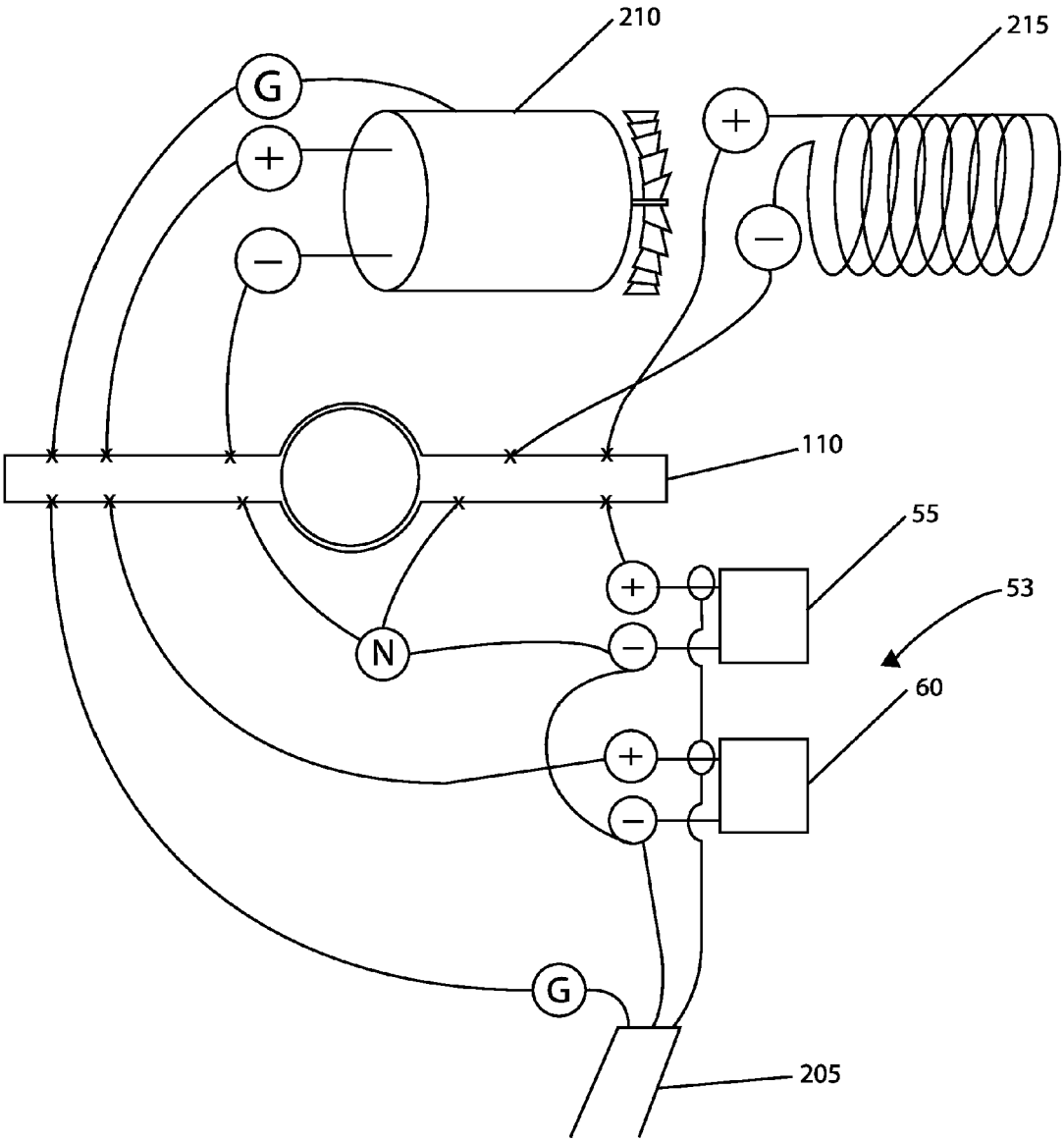
FIG. 11 is an electrical schematic of an embodiment of the present invention.

Regarding power supplied to fan and heating element components, FIG. 11 illustrates electrical connections. A typical AC supply cord 205 having a ground, hot, and neutral wires is electrically coupled to at least one switch 53, which in an embodiment may include a dedicated switch for fan speed 55 and temperature 60. Electrical contact is maintained by rotating connector 110 electrically coupled through one or more pairs of wires having an appropriate corresponding conductor pair. In one embodiment, fan 210 and heating element 215 may be controlled by the same switch, requiring that rotating connector 110 provides at least two conductors. In an alternative embodiment, wiring for fan speed 55 and heating element 215 are independent and require that rotating connector 110 provides at least four conductors. It should be clear that a rotatory electrical interface could contain a plurality of conductors and/or slip ring electrical contacts without departing from the spirit and scope of the present invention.

Figure 12:
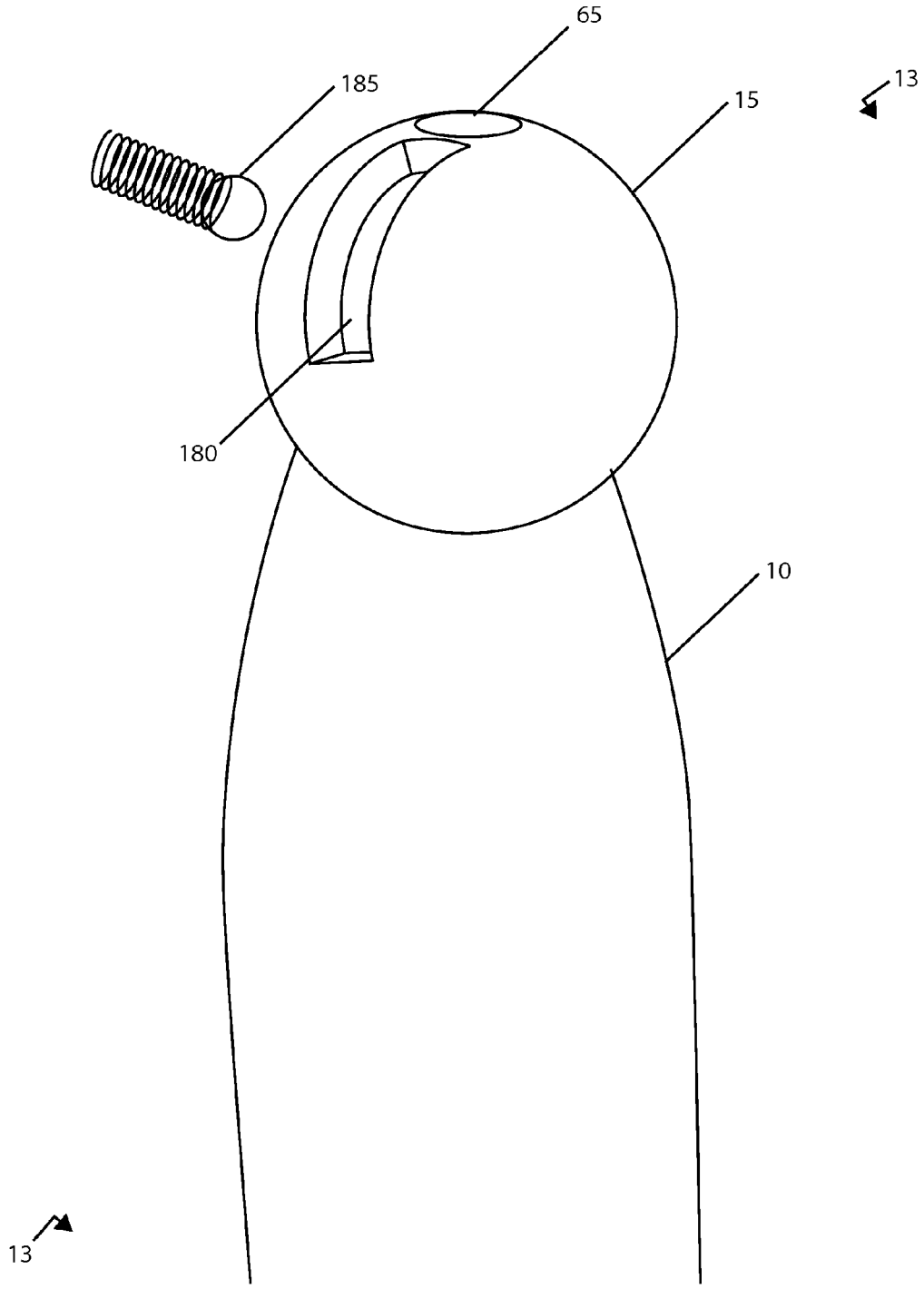
FIG. 12 is a perspective view of an alternative embodiment locking mechanism.
Figure 13:
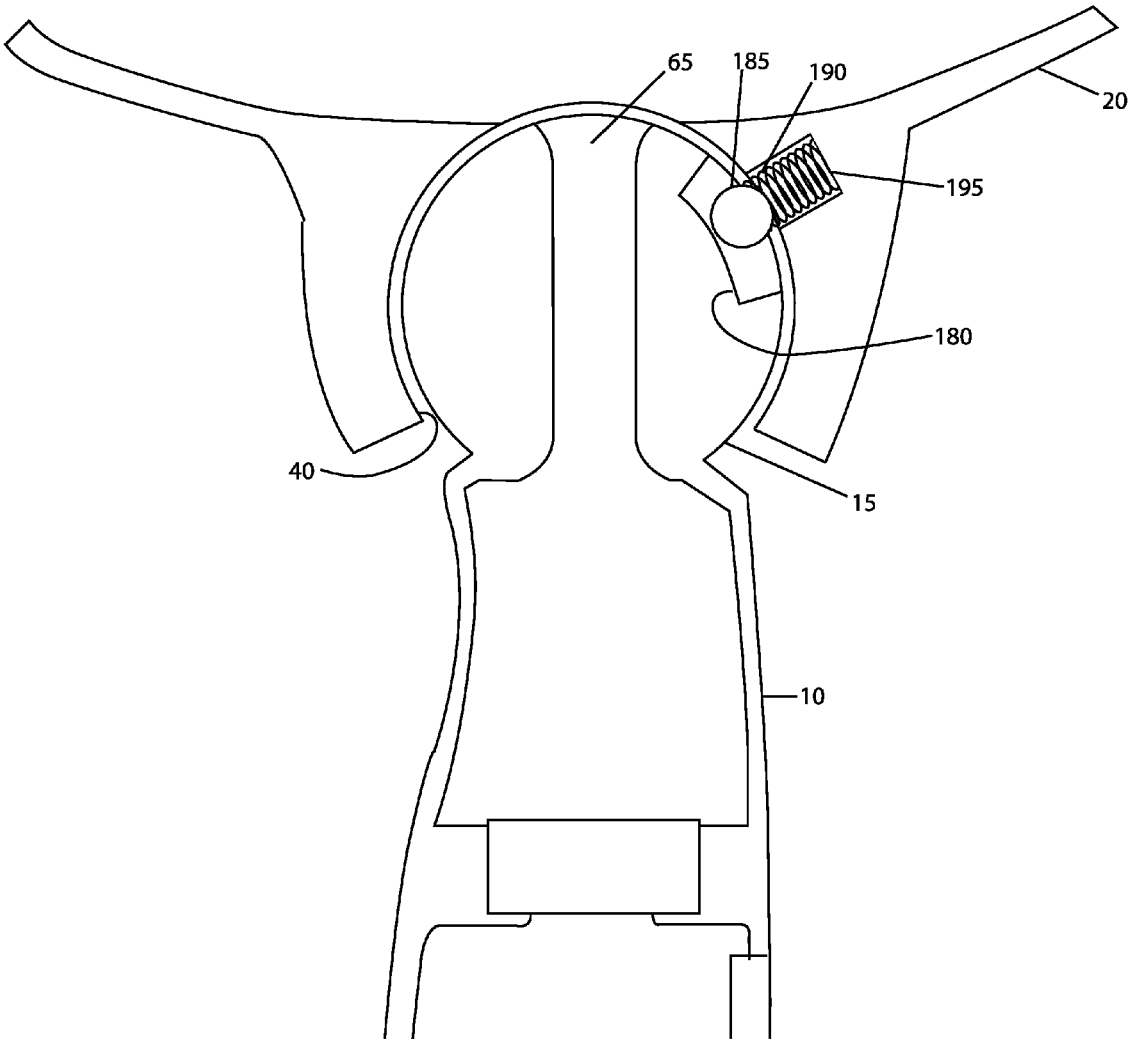
FIG. 13 is a cross-sectional view of an alternative embodiment locking mechanism taken through line 13-13 of FIG. 12.

Turning now to FIGS. 12 and 13, an optional embodiment barrel locking means is disclosed. Ball 15 is shaped to define locking recess 180. Projection 185 is biased toward ball 15 by spring 190, having a first spring end and second spring end, the first end located in spring recess 195 within socket 40 and the second spring end affixed to projection 185. When ball 15 is appropriately aligned within socket 40, projection 185 enters locking recess 180 to relatively and reversibly fix barrel 20 relative to handle 10. Barrel 20 can be moved when sufficient user exerted force overcomes spring 190's bias whereupon ball 15 is again movable within socket 40. The shaping and composition of projection 185 and depth and shaping of recess 180 can determine the force required to overcome the reversible fixing. Alternatively, a similar fixing functionality can be accomplished by frictional engagement between a portion of ball 15 and socket 40 which increase friction between the ball-and-socket joint when engaged. Yet another alternative means utilizes a dome projection on socket 40 engaging a detent on ball 15. It should be immediately recognized that a variety of indexed positions is possible; the invention permits a varied number and/or location of locking positions. This may be accomplished by duplicating the engagement means within the ball-and-socket joint. The desirability of specific reference positions of barrel 20 will depend on the size and shape of handle 10, barrel 20, the overall size and shape of apparatus 5, as well as the anticipated varied needs and practices of the end user.

Regarding general movement of the ball-and-socket joint, the friction between ball 10 and socket 40 will determine the force required to impart movement of barrel 20 relative to handle 10 and is dependent on many factors. In one embodiment, illustrated by FIG. 2 an optional limiter, such as washer 45, is disposed within socket 40 to provide increased frictional engagement between ball 15 and socket 40. In another embodiment, washer 45 is omitted. In another embodiment, ball 10, socket 40, or both may be surfaced sufficiently to provide an alternative amount of friction in the joint to keep barrel 20 and handle 10 statically engaged during typical hair dryer use. Further, factors such as the tightness of the joint and weight and balancing of barrel 20 and handle 10, may influence joint mobility and the desirable resistance to movement will be dependent on the variable size and mass of fan and heating components selected and the anticipated varied needs of different users.

Figure 14:
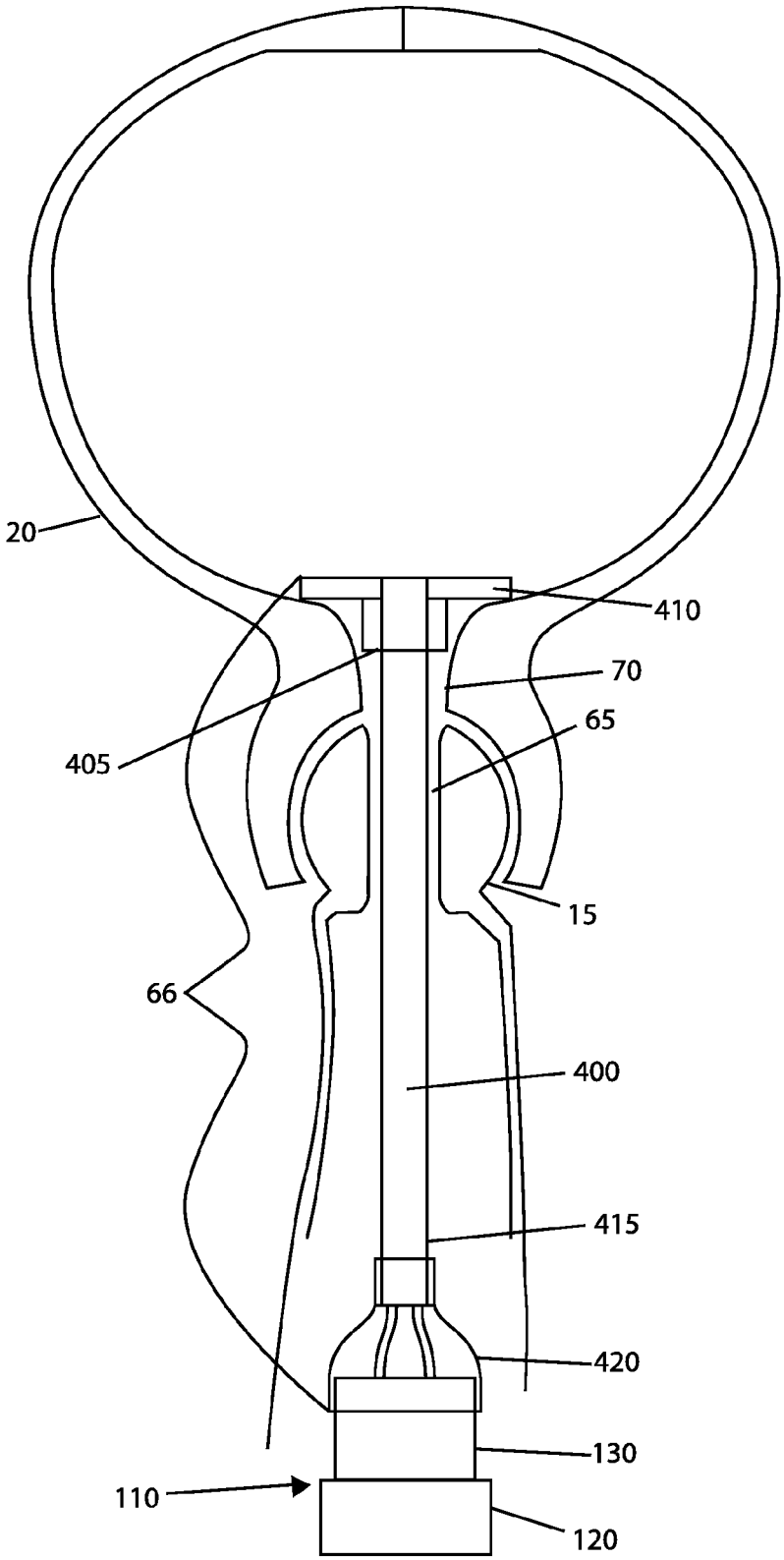
FIG. 14 is a cross-sectional view of an alternative embodiment linkage taken through line 14-14 of FIG. 1.

In an alternative embodiment, illustrated by FIG. 14 linkage 66 may be formed of a semi-rigid tubing 400 which passes through ball channel 65 and socket channel 70 of socket 40. Tubing 400 has tube first end 405 affixed to barrel 20 by barrel connector 410, and tube second end 415 is affixed to second end 130 of rotating connector 110 by coupler 420 which may be a plastic or rubberized bell boot. Functionally, rotation of barrel 20 will impart rotational motion to linkage 66 and second end 130 of switch 110 while permitting upward and downward vertical movement of barrel 20. Tubing 400 and couplers may be formed of plastic, including flexible PVC, urethane, or suitable semi-rigid materials. In an alternative embodiment, a rigid tube may be used which will permit rotation of barrel 20 relative to handle 10.

Figure 15:
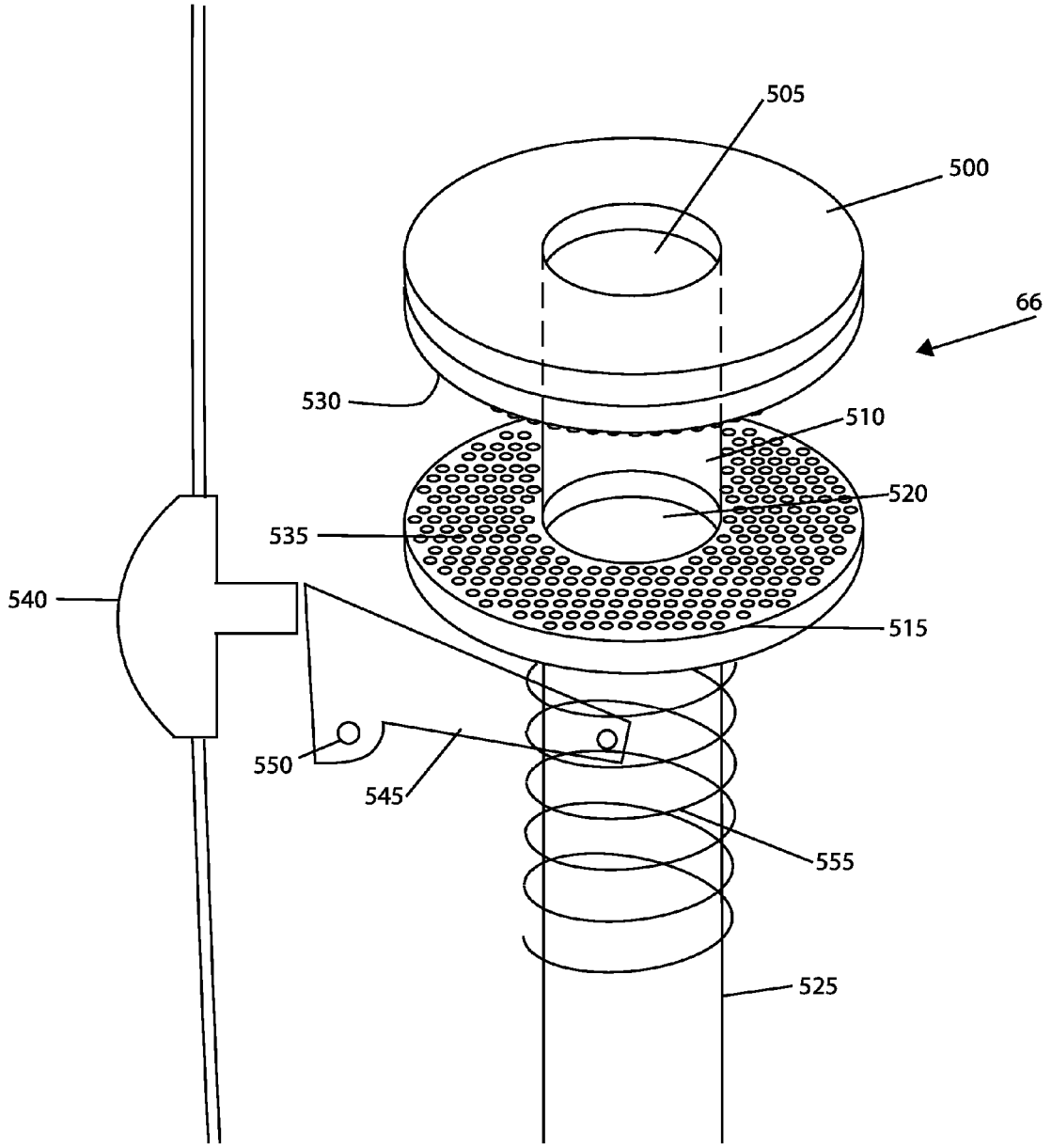
FIG. 15 is a perspective view of an alternative embodiment linkage system.
Figure 16:
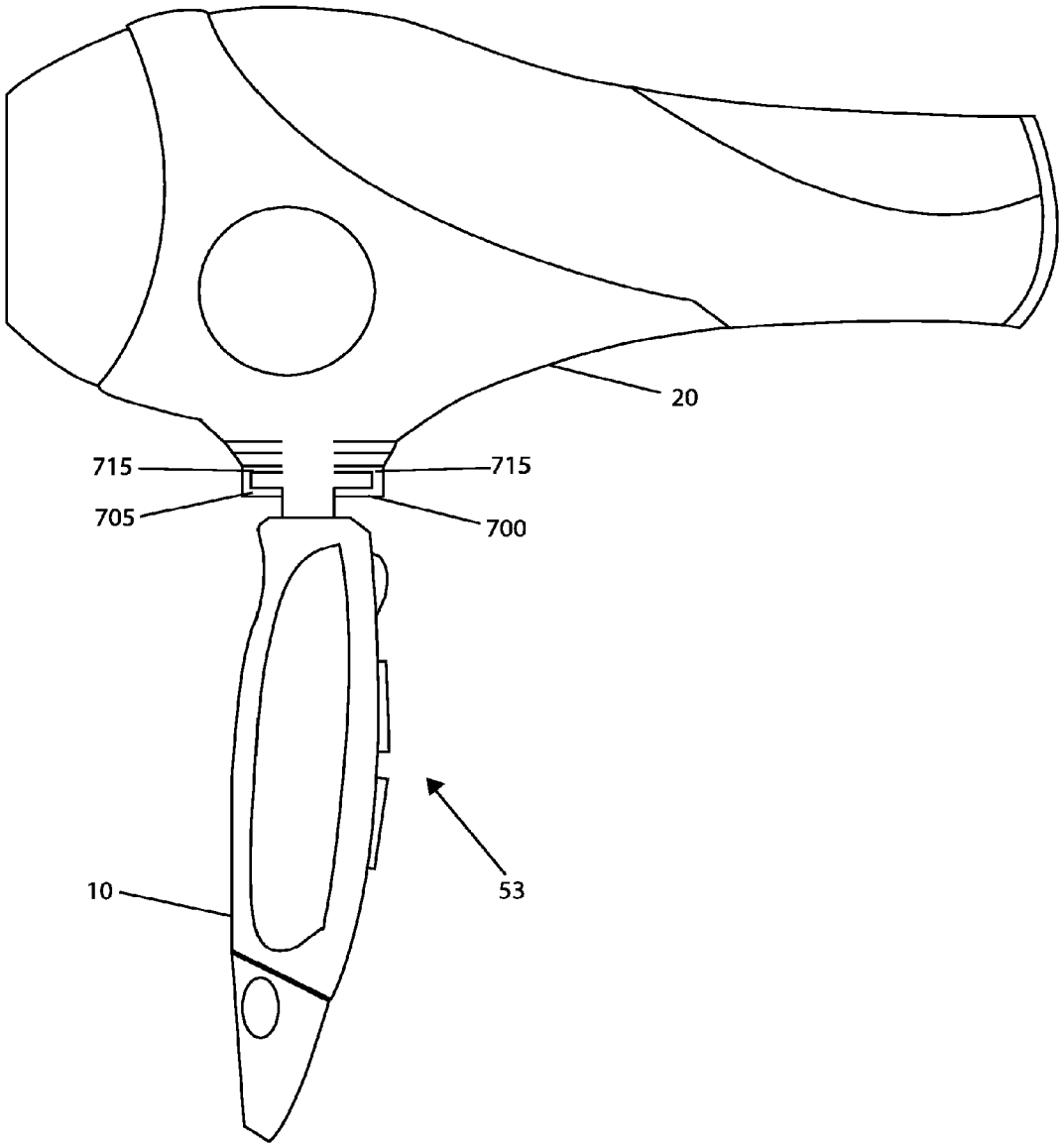
FIG. 16 is an elevation view of an alternative embodiment joint.

In an alternative embodiment, illustrated by FIG. 15, linkage 66 between barrel 20 and handle 10 comprises a first pressure plate 500 fixedly mounted to the undersurface of barrel 20 and shaped to define a centrally located aperture 505. Shaft 510 is disposed within aperture 505. A second pressure plate 515, shaped to define a centrally located aperture 520, is fixedly mounted on slip shaft 525 with shaft 510 being telescopically disposed within slip shaft 525. First pressure plate 500 has a first plate contact surface 530 and second pressure plate 515 has second plate contact surface. Surface 530 and 535 may be formed of an embossed or roughened surface permitting enhanced frictional engagement between the two surfaces. Alternatively, surface 530 and 535 may shaped to have projections with corresponding recesses to permit the same to register and lock. Button 540 is mounted within handle 10 and engages release arm 545 which is rotatably fixed by pivot point 550 and secured within the inner aspect of handle 10. The terminal end of arm 545 is fixed to slip shaft 525. Spring 555, having a first end and second end, is fixed to shaft 525 at spring's first end; the second end of spring 555 engaging second pressure plate 515.

Functionally, spring 555 biases second pressure plate 515 into contact with first pressure plate 500. Contact surface 530 and 535 prevent movement of first pressure plate 500 and second pressure plate 515 as well as movement of barrel 20 relative to handle 10. When the user wishes to rotatably adjust barrel 20 relative to handle 10, the user presses button 540 to pivot arm 545 on point 550 which moves slip shaft 525 downwardly, overcoming bias force of spring 555, and first pressure plate 500 and second pressure plate 515 are separated. Barrel 20 may then be freely rotated relative to handle 10. When the new desired position of barrel 20 is reached, button 540 is released whereupon spring 555 forces second pressure plate 515 into contact with first pressure plate 500 along first plate contact surface 530 and second plate contact surface 535.

In an alternative embodiment illustrated by FIG. 15, handle 10 is shaped to terminate in disc 715. Disc 715 is enclosed within a disc recess 700 located within an appropriately shaped barrel 20. As disc 715 can rotate within disc recess, handle 10 and barrel 20 can freely rotate as well. A rotatory electrical interface may be used to maintain electrical contact during rotation. For example, a rotating connecter such as Mercotac Model 230 and 430 may serve as rotating connector 110 and mounted in either the barrel or handle. Alternatively, electrical contact may be made through a slip ring 300, illustratively depicted by FIG. 8, mounted on the surface of disc 715 which may be electrically coupled to one or more switches 53. Electrical contacts illustrated in FIG. 8 may be mounted within barrel 20 and are electrically coupled to fan 210 and heating element 215. It should be noted that slip ring 300 could be mounted within disc recess 705 and electrically coupled to fan 210 and heating element 215, and brushes or contacts 305 mounted on disc 715 in electrical contact with switch 700. Electrical contact between ring and one or more contacts 715 is maintained as barrel 20 is freely rotated on handle 10, permitting current to flow. Of course it should be recognized that, in the alternative, barrel 20 could be shaped to form a disc and handle shaped to form a disc recess. Likewise, the location of slip ring and contacts is arbitrary: contacts may be located on the disc or disc recess and the slip ring may be mounted on the disc 715 or within disc recess 700. In one embodiment apparatus housing may be molded as a single piece with disc 715 and disc recess 700 integrally formed and incorporated into the molding.

Figure 17:
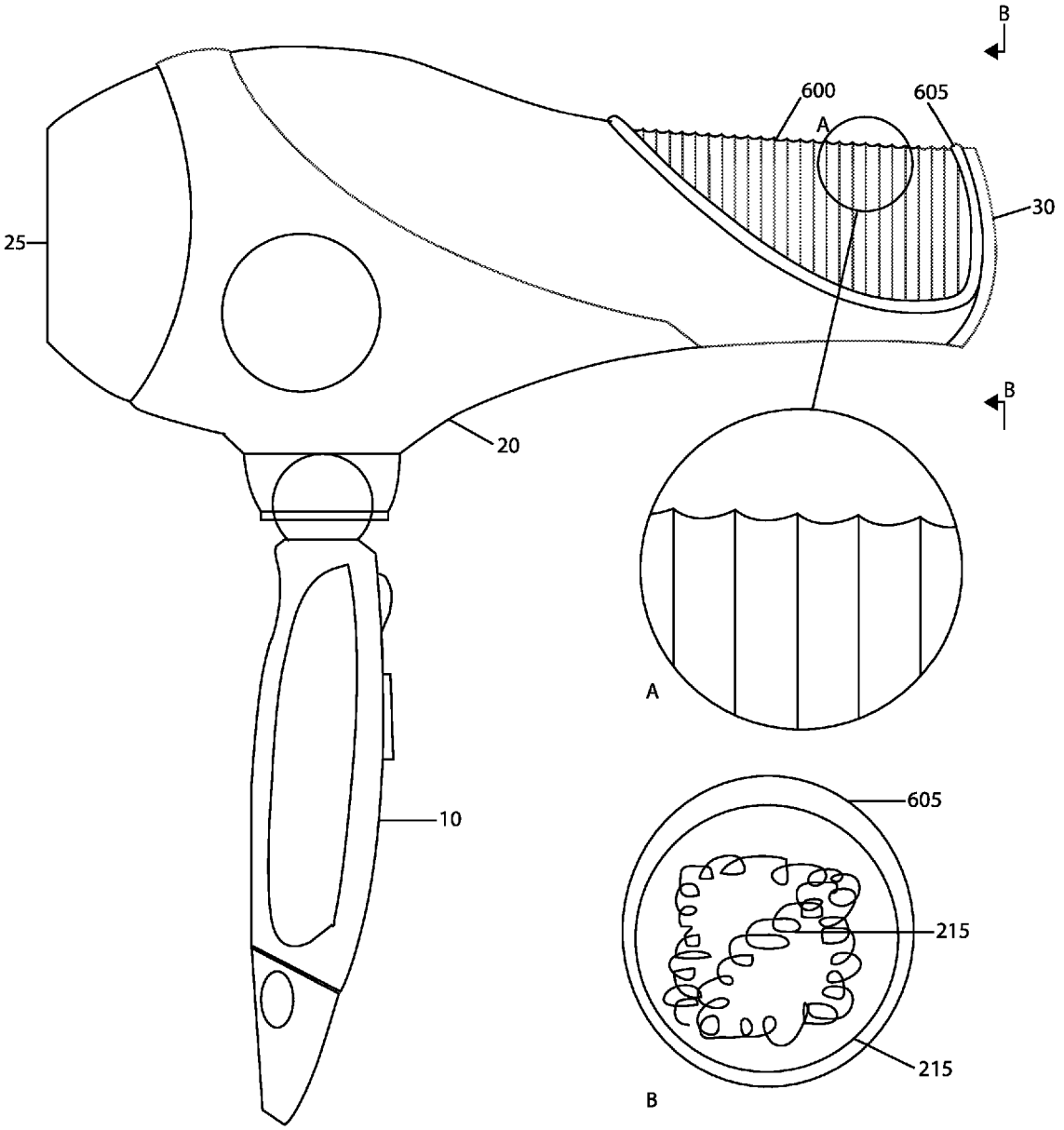
FIG. 17 is an elevation view with an alternative embodiment drying grill depicting an enlarged as "A" and front view of barrel as "B."

FIG. 17 demonstrates a variant styling/drying embodiment which may be utilized in conjunction with any prior embodiments described. A portion of barrel 20 is shaped to define grating 600 which may be comprised of metal or plastic. In one embodiment, barrel 20 is shaped to define barrel lip 605 into which a metallic embodiment of grating 600 engages and fits. During use, at least some heat generated by heating element 215 may escape through barrel 20 via grating 600 (illustrated by callout A) to heat a user's hair placed thereupon. In one embodiment, at least some air passing through barrel 20 may move through grating 600. In an alternative, grating 600 may be louvered to provide an adjustable degree of opening and airflow and/or thermal escape from within barrel 20. Lip 605 is formed around the perimeter of grating 600 and may act to maintain hair in contact with grating 600. In use, hair may be rested on grating 600 and maintained in place by lip 605. Heat and/or a variable volume of air may pass from within barrel 20 to escape from grating 600 to aid in drying and styling hair. Callout B of FIG. 17 illustrates a front view of the end of the terminal end of barrel 20 showing a portion of heating element 215 coils and the shape of lip 605.

It should be noted that in an alternative embodiment, apparatus 5 is formed of an integrally formed unitary housing, wherein the housing includes handle 10 and barrel 20 and a joint formed between handle 10 and barrel 20. The joint may be formed in a variety of ways to include ball-and-socket joint, disc joint, and hinge joint systems making the barrel movable relative to the handle.

In an alternative embodiment, a beam coupling may be used to horizontal (rotational) movement of joint as well as vertical movement of the barrel. It should also be noted that in an alternative embodiment, any system that permitting rotation between the handle and barrel may be utilized with the present invention.

From the foregoing, it is apparent to one skilled in the art that the present invention encompasses any hair drying apparatus, capable of being hand-holdable, which contains a joint permitting at least partial rotation between a handle and a barrel as well as any electrical coupling capable of maintaining electrical contact between a power source and one or more fans/heating elements. Specifically, in an alternative embodiment, wiring may be run from handle to barrel directly to the fan and heating element with the rotating electrical interface being located within the motor and/or heating element itself.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

We claim:

1. An adjustable hairdryer apparatus comprising:

a handle housing a portion of which shaped to define a ball, said ball having a ball channel passing therethrough;

a barrel housing having an intake end and outflow end, the underside of said barrel shaped to define a socket, said socket shaped to define a socket channel, wherein said ball and socket together form a joint;

at least one heating element disposed within said barrel;

at least one fan disposed within said barrel;

a rotatory electrical interface, wherein said rotatory electrical interface is a rotating connector, wherein said rotating connector has a first end and second end, said rotating connector disposed within said handle;

a linkage coupled to said second end, wherein at least a portion of said linkage passes through said ball channel, wherein said barrel is freely rotatable relative to said handle.

2. The apparatus of claim 1, wherein said linkage comprises a coil having a first end and second end, further comprising a first cap connector affixed to first end, further comprising a second cap connector coupled to second end, wherein first cap connector is coupled to first end of rotating connector, further comprising a fan housing, wherein said fan is mounted within fan housing, wherein second cap connector is coupled to fan housing.

3. The apparatus of claim 1, wherein said linkage comprises:

a first pressure plate, having a contact surface, shaped to define an aperture, said first pressure plate fixedly mounted to the barrel;

a shaft disposed within said first pressure plate aperture;

a slip shaft, wherein said shaft is telescopically disposed within the slip shaft;

a second pressure plate, having a contact surface, shaped to define an aperture, said second pressure plate fixedly mounted on slip shaft;

a button mounted within handle;

a release arm, having a terminal end, rotatably fixed by pivot point within handle, wherein said terminal end is fixed to the slip shaft;

a spring, having a first end and second end, said first end affixed to shaft, said second end engaging said second pressure plate.

4. The apparatus of claim 1, wherein said linkage comprises: a semi-rigid tubing, having a first tube end and second tube end, said tubing passing through ball channel and socket channel, wherein said first tube end is affixed to said barrel and said second tube end is affixed to said second end of the rotating connector.

5. An adjustable hairdryer apparatus comprising:

a hairdryer housing, wherein said housing is shaped to define a handle and a barrel, wherein a portion of said housing is shaped to define a joint disposed between said handle and barrel;

at least one heating element disposed within said housing;

at least one fan disposed within said housing;

a rotatory electrical interface disposed within said housing, at least a portion of said rotatory electrical interface freely rotatable therein, wherein said barrel may be rotated relative to said handle.

6. The adjustable hairdryer apparatus of claim 5, wherein said joint comprises a disc joint, wherein said joint comprises a disc recess and disc disposed within said disc recess, wherein disc is rotatable within said disc recess.

7. The adjustable hairdryer apparatus of claim 5, wherein said rotatory electrical interface is a rotating connector.

8. The adjustable hairdryer apparatus of claim 5, wherein said rotatory electrical interface is comprised of a slip ring system.

9. An adjustable hairdryer apparatus comprising:

a hairdryer housing, wherein said housing is shaped to define a handle and a barrel, wherein a portion of said housing is shaped to define a joint disposed between said handle and barrel;

at least one heating element disposed within said barrel;

at least one fan disposed within said barrel;

a rotatory electrical interface disposed within said housing, at least a portion of said rotatory electrical interface freely rotatable therein;

a linkage disposed within said housing, wherein a portion of said linkage is affixed to a portion of said rotatory electrical interface, wherein a portion if said linkage is affixed to said barrel, wherein rotation of barrel rotates linkage and said portion of rotatory electrical interface.

10. The adjustable hairdryer apparatus of claim 9, wherein said joint comprises a ball-and-socket joint.

11. The adjustable hairdryer apparatus of claim 9, wherein said rotatory electrical interface comprises a rotatable electrical connector.

12. The adjustable hairdryer apparatus of claim 9, wherein said rotatory electrical interface comprises a slip ring system.

13. The adjustable hairdryer apparatus of claim 9, wherein said linkage is comprises semi-rigid tubing having a first end and second end, wherein the tube first end is affixed to said barrel and tube second end is affixed to a portion of said rotatory electrical interface.

14. The adjustable hairdryer apparatus of claim 1, wherein said barrel is shaped to define a barrel lip, further comprising a grating fitted within said barrel lip.

15. The adjustable hairdryer apparatus of claim 9, further comprising a locking means.

16. The adjustable hairdryer apparatus of claim 9, further comprising a styling grate.

17. The adjustable hairdryer apparatus of claim 16, wherein a portion of said barrel is shaped to define a styling grate.

18. The adjustable hairdryer apparatus of claim 16, wherein a portion of said barrel is shaped to define a barrel lip, further comprising a grating engaging and fitting within said lip.

* * * * *